United States Patent [19]

Eberle

[11] Patent Number: 5,005,716

[45] Date of Patent: Apr. 9, 1991

[54] POLYESTER CONTAINER FOR HOT FILL LIQUIDS

[75] Inventor: Tod F. Eberle, Saline, Mich.

[73] Assignee: Hoover Universal, Inc., Plymouth, Mich.

[21] Appl. No.: 477,115

[22] Filed: Feb. 7, 1990

Related U.S. Application Data

[63] Continuation of Ser. No. 211,464, Jun. 24, 1988, abandoned.

[51] Int. Cl.[5] ..... B65D 1/02; B65D 1/42; B65D 23/00

[52] U.S. Cl. ..... 215/1 C; 220/606

[58] Field of Search ..... 215/1 C; 220/66, 70, 220/DIG. 14, 606, 608, 609, 633, 635

[56] References Cited

U.S. PATENT DOCUMENTS

| | | | |
|---|---|---|---|
| 4,134,510 | 1/1979 | Chang | 220/70 X |
| 4,174,782 | 11/1979 | Obsomer | 215/1 C |
| 4,249,666 | 2/1981 | Hubert | 215/1 C |
| 4,276,987 | 7/1981 | Michel | 215/1 C |
| 4,426,013 | 1/1984 | Cherchian | 220/70 |
| 4,427,705 | 1/1984 | Wyslotsky | 220/66 |
| 4,542,029 | 9/1985 | Caner | 220/66 |
| 4,598,831 | 7/1986 | Nakamura | 215/1 C |
| 4,818,575 | 4/1989 | Hirata et al. | 215/1 C X |
| 4,863,046 | 5/1989 | Collette et al. | 215/1 C |

FOREIGN PATENT DOCUMENTS

| | | | |
|---|---|---|---|
| 2146137 | 6/1987 | Japan | 215/1 C |

*Primary Examiner*—Sue A. Weaver

*Attorney, Agent, or Firm*—Harness, Dickey & Pierce

[57] ABSTRACT

A polyester container particularly adapted for hot fill applications having an improved base configuration. The container base has an outer circular ring defining a support plane for the container with a central outwardly concave dome portion therein. The dome portion includes a number of reinforcing rings formed along concentric tangent lines. In accordance with several embodiments, the circular rings are uninterrupted, whereas in other embodiments, the rings are interrupted at regular angular intervals with relatively smooth zones or hemispherical pockets therebetween. The containers provide excellent mechanical stability in response to positive and negative pressure within the container, and also in response to unrelaxed retractive stresses within the container material which tend to cause deformation of the container, particularly when exposed to elevated temperatures during demolding of the container and during the hot fill cycle.

6 Claims, 5 Drawing Sheets

POLYESTER CONTAINER FOR HOT FILL LIQUIDS

This is a continuation of U.S. patent application Ser. No. 211,464, filed June 24, 1988, now abandoned.

BACKGROUND AND SUMMARY OF THE INVENTION

This invention relates to a polyester container and particularly to such a container having an improved base configuration.

Polyester containers have been replacing metal and glass containers with increasing frequency. The popularity of these products stems in part to improvements in resin composition, manufacturing processes, and container designs. Typical polyester containers such as those made from polyethylene terephthalate (PET) material are formed in a process in which an elongated tubular preform made by injection molding or other processes is heated and placed into a blow molding cavity. A pressure differential is applied which causes it to expand to conform to the inside surface of the mold cavity, thus providing a semi-rigid thin-walled container. Since the container is exposed to various pressures and forces during processing and use as will better be explained below, it must be designed to respond to such physical influences while maintaining a designed configuration. Random or asymmetrical buckling or deformation of the container would produce an esthetically and commercially unacceptable product.

Containers must be designed to be stable when set on a horizontal surface. In the past, many polyester containers were designed to have a rounded bottom which required a separate base component which was glued to the container to provide a flat support plane. More recent polyester container designs, however, are integral structures having a bottom which forms an outer support ring with a central outwardly concave depressed center, often referred to as a "champagne bottom". In addition to the requirements of maintaining a desired configuration, there is a further need to design the container to minimize the quantity of material needed to form it. In the past, polyester containers were designed with a reinforced base having ribs or webs of increased thickness of polyester material which tended to increase the mass of raw material needed to form the product.

During the production cycle of a blow molded polyester container, the preform is typically axially stretched and inflated to impart radial elongation to the material. In the art, such forming is known as biaxial elongation. Such elongation imposes retractive stresses in the material which, if not relaxed or physically restrained, tend to cause the article to shrink and deform in certain conditions in the directions of elongation. The influence of such unrelaxed retractive stresses is particularly significant during certain phases of the production cycle of the container. Immediately after demolding of the container, the elevated temperature of the material causes it to be less rigid than the final product. Accordingly, such unrelaxed retractive stresses tend to have more influence during this phase of the production cycle.

In the past, most polyester containers were used to contain liquids that are initially dispensed into the container at room temperature or chilled. Presently, however, there is more interest in using polyester containers for so-called "hot-fill" applications where the beverage or product is dispensed in the container initially at an elevated temperature and is then immediately sealed. Hot-fill applications impose additional mechanical stress inputs to the container structure. Immediately after the hot liquid is dispensed into the container, its temperature decreases the rigidity of the polyester material, thus making it more subject to the unrelaxed retractive stresses mentioned previously. The container must sustain internal pressure changes while maintaining its configuration. For example, as the hot-filled liquid cools, it shrinks in volume which has the effect of producing a negative pressure in the container. In use, the container must also be resistant to deformation when being handled or dropped which causes sudden increases in internal pressure.

In accordance with this invention, a polyester container is provided having an improved design base structure which provides structural rigidity and resistance against random deformation and shrinkage in response to the previously mentioned mechanical and thermal stresses.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
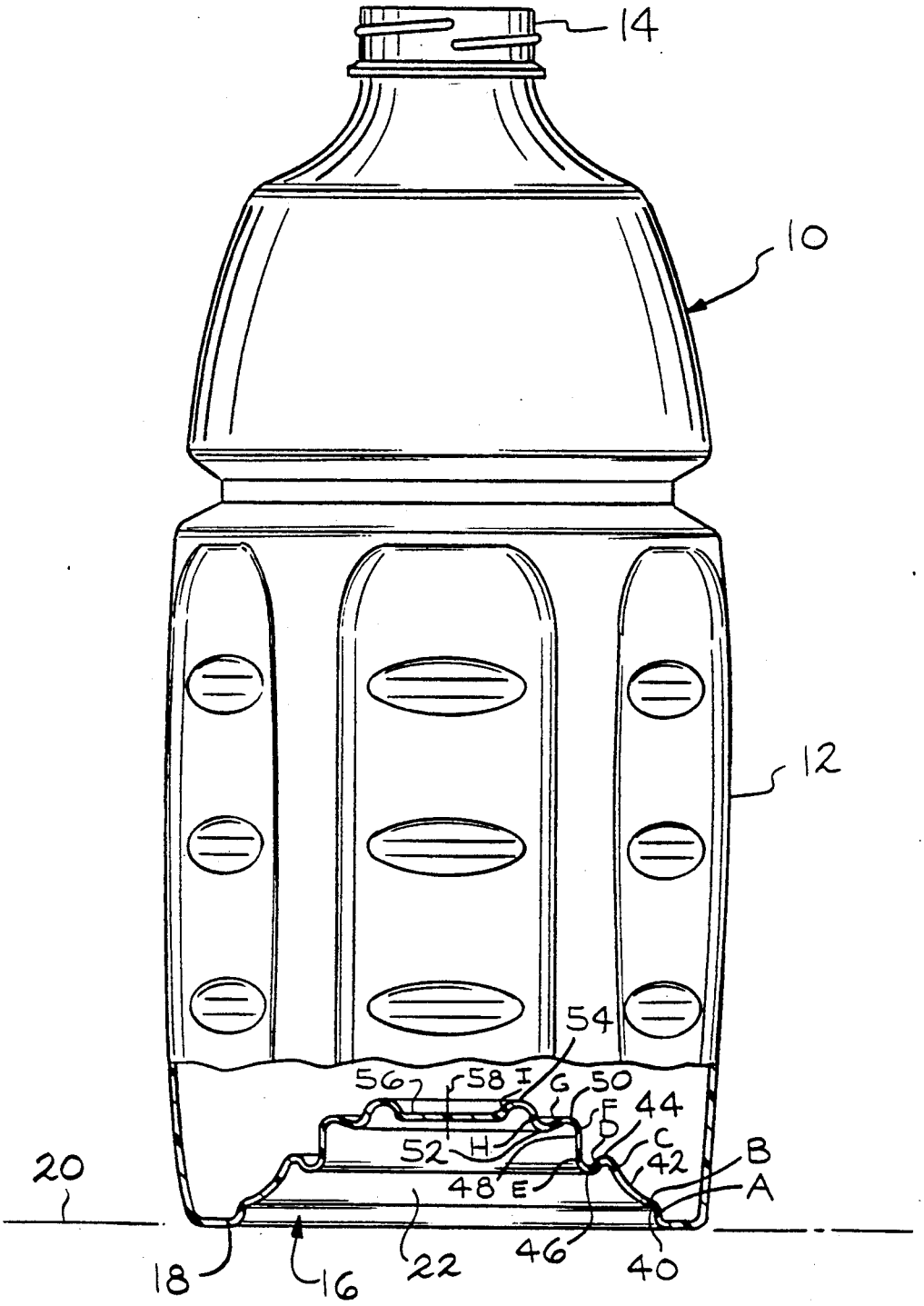
FIG. 1 is a side elevational view of a container having a base in accordance with a first embodiment of the present invention with the bottom cut-away and sectioned.
Figure 2:
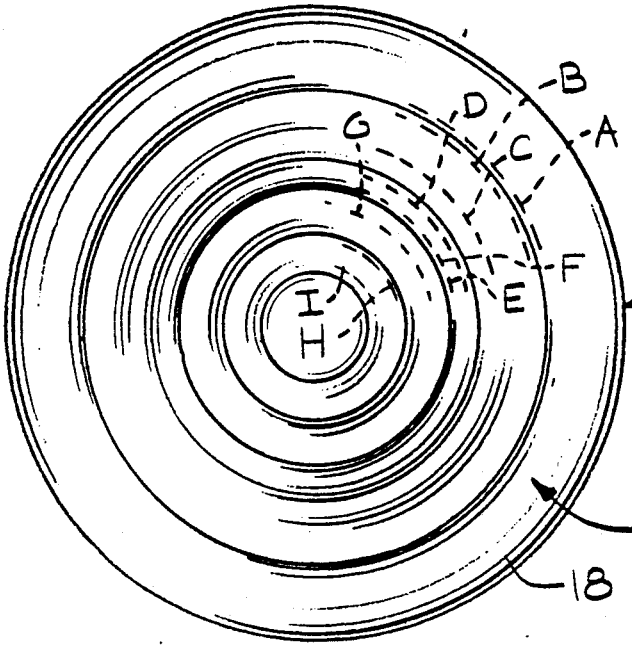
FIG. 2 is a bottom view of the base of the container shown in FIG. 1.

FIGS. 1 and 2 illustrates an example of a polyester bottle made from PET material which is generally designated by reference number 10. Container 10 generally includes sidewall portion 12, an upper closure mouth 14, and a base portion 16. Sidewall 12 can be formed to a multitude of different configurations to provide the desired structural characteristics, and product identification and aesthetic intent. Mouth 14 is adapted to receive a threaded closure cap (not shown) and is a rigid ring which restrains the mechanical loads imposed by such closures. Base portion 16 generally forms an outer ring 18 which defines support plane 20 and a central outwardly concave dome region 22. The configuration of base portion 16 which incorporates the features of the present invention will be described in greater detail below.

Figure 3:
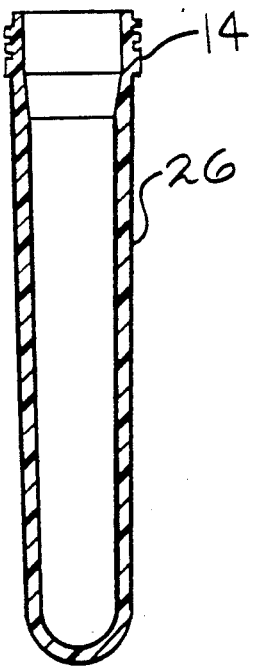
FIG. 3 is a cross-sectional view of a preform of polyester material used in a blow molding process to form containers according to this invention.
Figure 4:
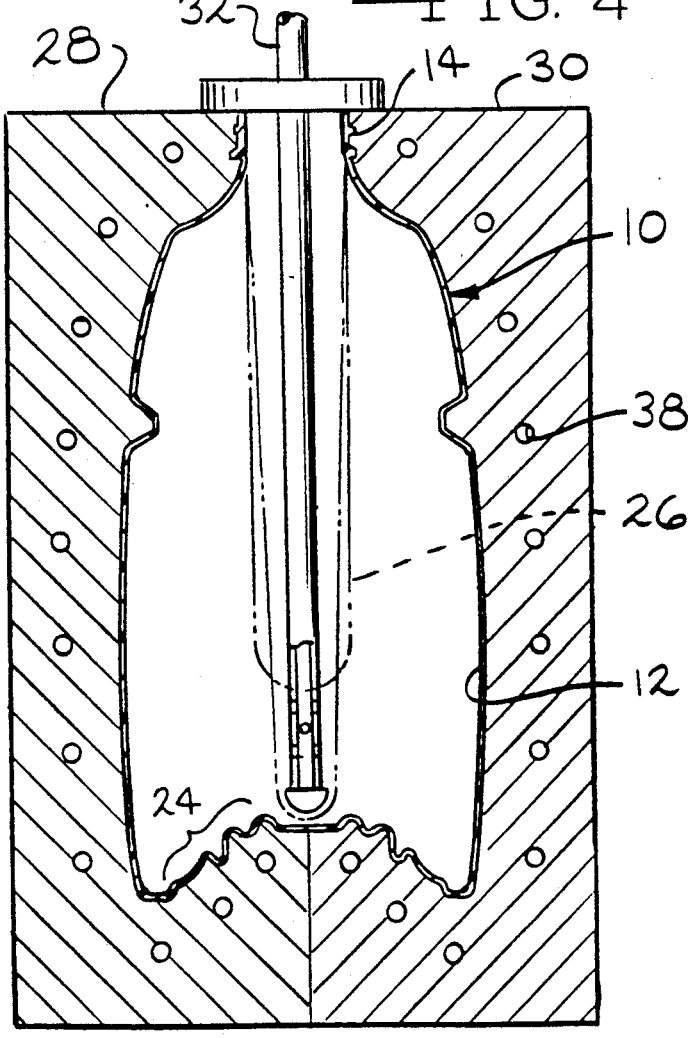
FIG. 4 is a cross-sectional view through a blow molding cavity showing the container of FIG. 1 in its final configuration and showing, in phantom lines, axial stretching of the preform.

FIGS. 3 and 4 illustrate a fabrication process for forming container 10. FIG. 3 shows preform 26 having a shape similar to a laboratory test tube except that closure mouth 14 is fully formed. In FIG. 4, preform 26 is loaded into blow molding mold halves 28 and 30. Preform 26 is heated and plunger 32, as shown in FIG. 4, is used to axially elongate the preform as it is expanded through differential pressure to conform to the inside surface of mold halves 28 and 30. During such expansion, container 10 undergoes a combination of radial and axial elongation. As mentioned previously, such elongation gives rise to retractive stresses in the final product. The retractive stresses become particularly significant in the radially outer portions of center dome 22 since that material undergoes increased elongation as compared with the center area and is therefore subject to significant shinkage. The transition region 24 shown in FIG. 4 between the center of bottom portion 16 where the material is substantially unoriented and the outer area at ring 18 where the material is highly oriented is particularly susceptible to random and unsymmetrical buckling.

Mold halves 28 and 30 are shown with coolant passages 38 which are provided to control the temperature of the molds and may be used to provide differential temperatures within the mold to provide various material characteristics in designated areas of the container, such as described in U.S. Pat. Nos. 4,497,855 and 4,318,882, which are hereby incorporated by reference. Those patents describe a container which is molded in a first configuration and then remolded to a larger volume configuration, such that when the hot-fill liquid contracts during cooling, the container returns to its original configuration in response to the plastic's structural "memory" of the first configuration. Bottle 10 in accordance with this invention may be formed using this technology.

Base portion 16 according to a first embodiment of this invention is best described with reference to FIGS. 1 and 2. The radially outer portion of base portion 16 is rounded inwardly to define ring 18. Dome 22 has a corrugated appearance defined by a plurality of concentric reinforcing rings. Tangent points designated by letters A through I in FIG. 1 are used to describe the configuration of dome 22 and designates intersections of tangent lines identified by the same letters as shown in FIG. 2. The tangent lines define a point of inflection or change in radius of the container shape. Line A represents the inner boundary of ring 18. Concave ring 40 extends between lines A and B. A large radius convex ring 42 extends between lines B and C. Outwardly concave ring 44 extends between lines C and D and merges into convex ring 46. Wall 48 between lines E and F is generally vertical with respect to container 10, and transitions to rings 50, 52 and 54 between lines F through J which are outwardly concave, convex and concave, respectively. The center of dome 22 is defined by a flat center disk 56. Tangent lines A through I are all concentric about disk center point 58 and provide an accordion-like or serpentine cross-sectional configuration for the container base.

The configuration of base portion 16 provides a number of structural benefits. Due to the rigidity provided by the concave and convex rings, base portion 16 is reinforced against dimensional changes caused by the presence of unrelaxed retractive stresses within the container material when its temperature is elevated, particularly during demolding and hot-filling operations as mentioned above. This reinforcement effect is provided in the critical transition area of base 16 where it is particularly needed. Furthermore, the reinforcing rings act as a plurality of concentric pressure responsive pistons or diaphragm areas which are able to undergo limited excursion to accommodate changes in container internal pressure caused by volume shrinkage, carbonation of filled liquid, external force inputs, etc. Although such limited excursion of areas of dome 22 is permitted in response to such pressure changes, it maintains a regular and ordered appearance without random buckling, bulging, pinching, etc. The curved portions of bottom 16 also form stiff rings which resist forces imposed by unrelaxed contractive forces which, as mentioned previously, form a gradient in the radial direction from center point 58. Significantly, the mechanical characteristics of base portion 16 are provided with a thin-walled configuration without the requirement for increased thickness ribs or other reinforcing features.

Figure 5:
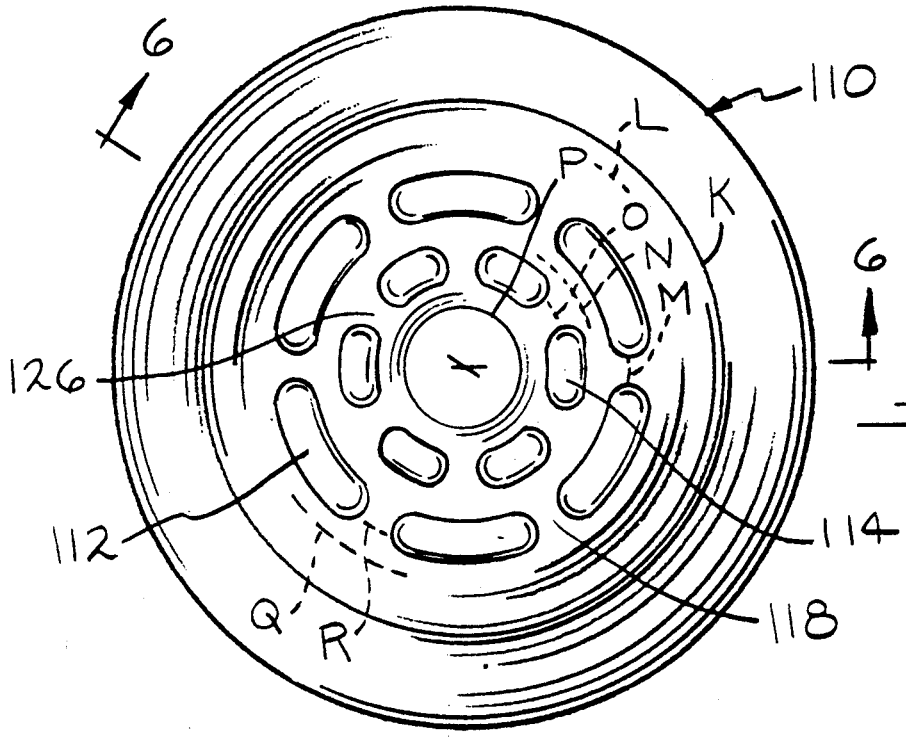
FIG. 5 is a bottom view of a container base in accordance with a second embodiment of this invention.

FIG. 5 illustrates base portion 110 in accordance with a second embodiment of this invention which, like the previously described base portion 16, can be used with containers 10 of various configurations. Base portion 110 varies principally from that previously described in that the reinforcing ring features are interrupted at regularly spaced intervals as shown in FIG. 5.

Figure 6:
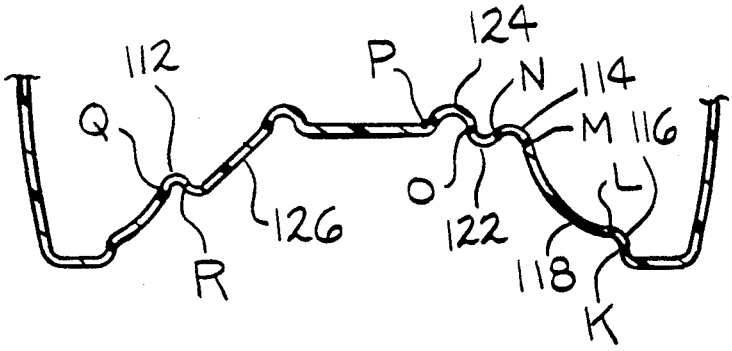
FIG. 6 is a cross-sectional view taken along line 6—6 of FIG. 5.

In FIG. 6, letters are also used to identify the position of tangent or break lines as previously defined. The section lines of FIG. 6 are taken such that the left-hand portion of the section is taken through outer reinforcing domes 112, whereas the right-hand portion of the section line shows the configuration of inner ring of domes 114. As shown in FIG. 6, the outermost concave ring 116 is generally similar to ring 40 according to the first embodiment which merges into a large radius convex ring 118 between tangent lines L and M which is between adjacent domes 112. Tangent lines M through P define dome 114 and rings 122 and 124. On the left-hand side of the section of FIG. 6, the area corresponding to ring 118 has tangent lines Q and R defining dome 112, whereas a flat portion 126 is present in the place of dome 114. As shown in FIG. 5, outer domes 112 are interrupted by generally smooth areas 118, whereas domes 114 are interrupted by areas 126. This configuration also provides excellent stability in response to thermal and mechanical loadings on the base portion 116. As shown in FIG. 5, this embodiment is also characterized by concentric tangent lines centered at the center of base 110.

Figure 7:
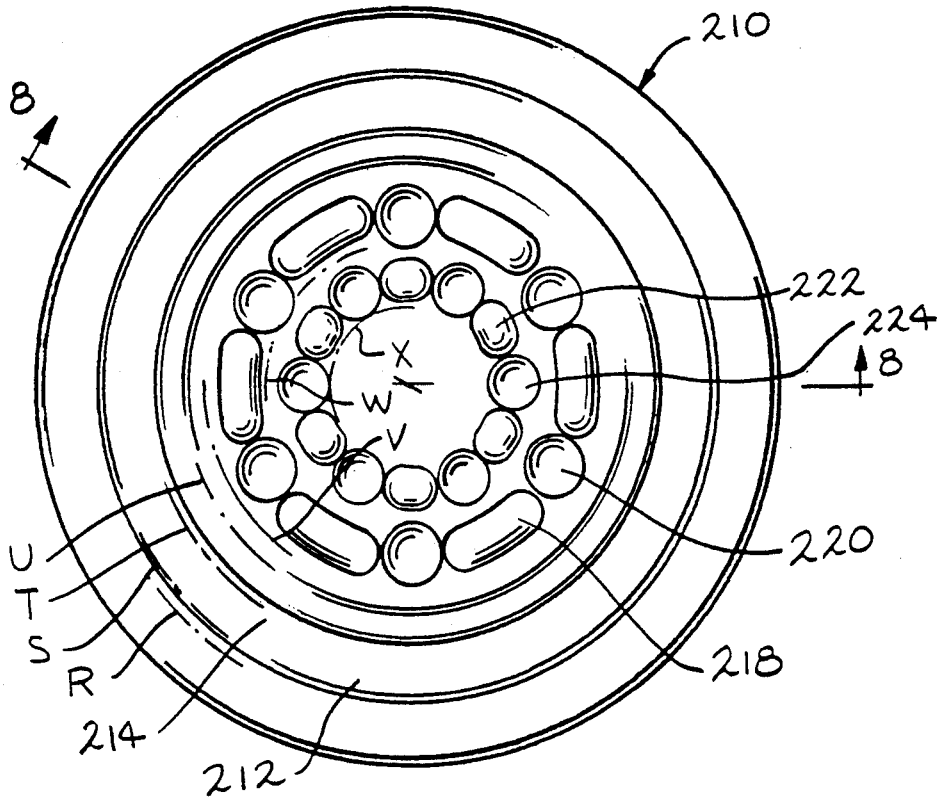
FIG. 7 is a bottom view of a container base in accordance with a third embodiment of this invention.
Figure 8:
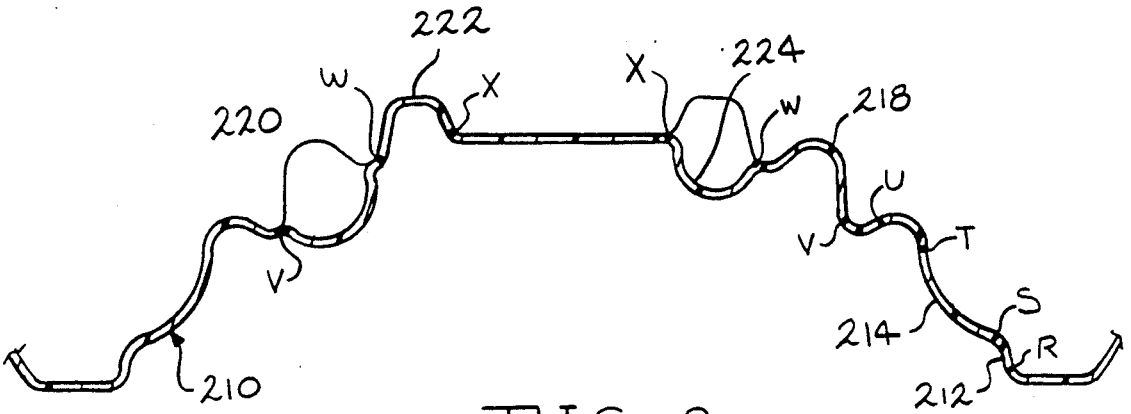
FIG. 8 is a cross-sectional view taken along line 8—8 of FIG. 7.

A container base portion in accordance with a third embodiment of this invention is shown in FIG. 7 and is generally designated by reference number 210. This embodiment is also designated by tangent lines as the earlier embodiments. Base portion 210 is similar to base 110 in that the concentric reinforcing features formed in the base are interrupted at regular intervals. For bottom 110, however, the interruptions are formed by generally smooth conical surfaces which interrupt the reinforcing domes. For base portion 210, however, the reinforcing rings are interrupted with generally spherical outwardly convex protrusions which are formed in the molding die using a ball milling tool. Like the first embodiment, base 210 initially forms a ring 212 between tangent lines R and S followed by a slightly outwardly convex ring 214 between tangent lines S and T. An uninterrupted outwardly concave ring 216 is provided between tangent lines T and U. A second concave ring 218 is positioned between tangent lines V and W, and is interrupted at spherical pockets 220 which are equally angularly spaced about the periphery of base 210. The innermost concave ring 222 is similarly interrupted at regularly angularly spaced spherical pockets 224 between tangent lines W and X. Like the second embodiment, the interruptions in the reinforcing rings are radially offset as indicated by the positioning of the section lines for forming FIG. 8. Pockets 220 and 224 of base portion 210 can be formed from a variety of tools but are spherical in configuration as shown in the figures. The rings 218 and 222 between spherical pockets 220 and 224, respectively, are formed to blend smoothly into the pockets to prevent the generation of stress concentrations caused by sharp corners.

Figure 9:
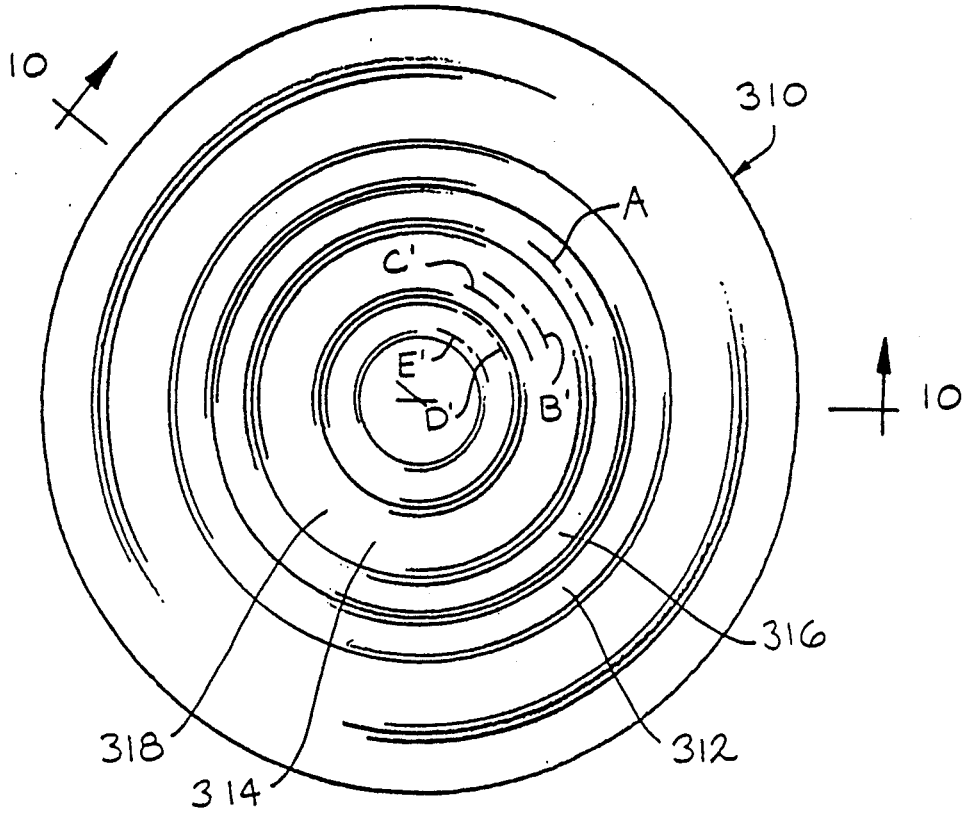
FIG. 9 is a bottom view of a container base in accordance with a fourth embodiment of this invention.
Figure 10:
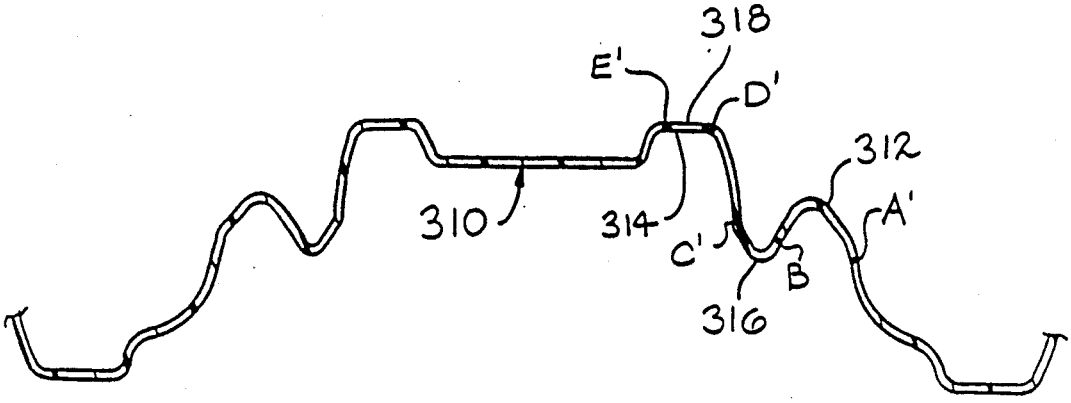
FIG. 10 is a cross-sectional view taken along line 10—10 of FIG. 9.

A container base configuration in accordance with a third embodiment of this invention is shown in FIGS. 9 and 10 and is generally designated by reference number 310. Like the previously described embodiments, tangent lines are used to designate changes in the curvature of the reinforcing features of the base. Base portion 310 varies from the prior embodiments in that it includes a fewer number of reinforcing ring features. For this embodiment, two rather than three rings 312 and 314 are provided with an outwardly concave configuration. Ring 312 is formed between tangent lines A′ and B′, whereas ring 314 is formed between tangent lines D′ and E′ with outwardly convex ring 316 formed therebetween. This embodiment also varies somewhat from the prior embodiments in that a generally flat circular band 318 is formed between tangent points D′ and E′, rather than providing a circular cross-section ring in that area. In other respects, however, base 310 performs like the previously described embodiments for providing rigidity and reinforcement for the base portion in the area where unrelaxed retractive stresses are predominant.

While the above description constitutes the preferred embodiments of the present invention, it will be appreciated that the invention is susceptible to modification, variation and change without departing from the proper scope and fair meaning of the accompanying claims.

What is claimed is:

1. A PET container formed by blow molding and adapted to be filled with liquid at an elevated temperature above room temperature, said container comprising an upper portion defining a sealable closure, a sidewall portion, and a base portion closing the bottom of the container and formed integral with said sidewall portion, said base portion having a generally flat outer support ring at the lower end of said sidewall portion that is substantially concentric with said sidewall portion, a dome formed integral with said outer ring and extending upwardly into said container and terminating in a central disc portion that is also substantially concentric with said sidewall portion, said dome also including an annular wall extending between said disc portion and said outer ring, a portion of said annular wall being subject to deformation by virtue of the presence therein of unrelaxed retractive stresses resulting from blow molding and the heating effect of the filling liquid at said elevated temperature, said annular wall being shaped to resist deformation by said stresses by reducing the area of said dome in which said stresses may be formed by providing a series of alternately arranged radially upwardly sloping and radially downwardly sloping portions in said annular wall which provide said annular wall with a serpentine appearance extending radially from said disc portion along said dome down to said outer ring when viewed in radial cross section, said upwardly and downwardly sloping portions thereafter forming at least one inwardly concave reinforcing ring and at least one inwardly convex reinforcing ring being substantially concentrically positioned around said central disc portion to thereby reinforce the ability of said annular wall to resist deformation during filling of the container with liquid at said elevated temperature.

2. A container according to claim 1 wherein said concave and said convex reinforcing rings are circumferentially continuous.

3. A container according to claim 1 wherein said concave and said convex reinforcing rings are interrupted at circumferentially angularly spaced areas.

4. A container according to claim 3 wherein said interruptions are outwardly convex substantially hemispherical domes which blend smoothly with said annular wall to prevent the generation of stress concentrations caused by sharp corners.

5. A container according to claim 1 wherein said base portion has three outwardly concave rings with two outwardly convex rings therebetween.

6. A container according to claim 1 wherein said base portion has two outwardly concave rings with an outwardly convex ring therebetween.

* * * * *